US005619585A

United States Patent [19]

Grasso

[11] Patent Number: 5,619,585

[45] Date of Patent: Apr. 8, 1997

[54] MEANS FOR AFFIXING AN ORNAMENTAL SCULPTURE TO A SOUND EMITTING DEVICE

[76] Inventor: Mark A. Grasso, 20748 Pacific Coast Hwy., Malibu, Calif. 90265

[21] Appl. No.: 275,303

[22] Filed: Jul. 14, 1994

[51] Int. Cl.[6] ..... H04R 25/00

[52] U.S. Cl. ..... 381/188; 381/205

[58] Field of Search ..... 381/188, 152, 381/205, 189, 88, 90; 181/150, 199; 446/369, 302, 303, 391

[56] References Cited

U.S. PATENT DOCUMENTS

| | | | |
|---|---|---|---|
| 4,032,725 | 6/1977 | McGee | 381/205 |
| 4,296,280 | 10/1981 | Richie | 381/88 |
| 4,521,205 | 6/1985 | Spector | 446/302 |
| 5,321,756 | 6/1994 | Patterson, Jr. et al. | 381/205 |

*Primary Examiner*—Wing F. Chan
*Assistant Examiner*—Huyen D. Le
*Attorney, Agent, or Firm*—Hawes, Fischer & Dickinson

[57] ABSTRACT

An ornamental sculpture having an aesthetically pleasing shape (e.g. such as the face of an animal) is easily and reliably affixed to the front of an electronic sound emitting device, such as a portable audio cassette player, or the like. The ornamental sculpture has a hollow interior and a plurality of sound holes so that sound emitted by an audio speaker of the sound emitting device appears to come from the sculpture. According to a first embodiment of the invention, the sculpture is affixed to the sound emitting device by a speaker grille, one end of which retains the audio speaker outside the sound emitting device to be surrounded by the sculpture. According to a second embodiment of the invention, a plurality of attachment hooks extend from the sound emitting device for receipt within corresponding slots formed in the ornamental sculpture whereby to affix the sculpture to the sound emitting device.

11 Claims, 6 Drawing Sheets

MEANS FOR AFFIXING AN ORNAMENTAL SCULPTURE TO A SOUND EMITTING DEVICE

BACKGROUND OF THE INVENTION

1. Field of the Invention

This invention relates to means for easily and reliably affixing an ornamental sculpture having an aesthetically pleasing shape to the front of a sound emitting device, such as a portable audio cassette player, or the like, which also functions as a toy.

2. Background Art

Typically, portable electronic sound emitting devices (e.g. cassette players, radios, walkie-talkies, and the like) are devoid of any ornamentation. However, where such sound emitting devices will also be used as toys, it may be desirable to include ornamentation to improve marketability and appeal to children. By way of example only, an ornamental sculpture representing the friendly face of an easy to recognize animal could be affixed to a sound emitting device to identify the device as a toy and increase interest in and the chance that children will wish to use such toys.

One well known means for attaching an ornamental sculpture to a sound emitting toy would involve adhesives, whereby the sculpture is bonded to the device. However, this technique requires that time be expended for applying the adhesive and then waiting for the adhesive to cure before the toy can be packaged. An improperly applied adhesive might result in the sculpture breaking off the toy during use. Consequently, a child might abandon the toy even if the electronics thereof remain fully functional.

What is more, it would be desirable that the ornamental sculpture be affixed to the sound emitting device so that the sculpture and the usual audio speaker of the device cooperate to provide a life-like appearance. More particularly, it is preferable that the ornamental sculpture not block the speaker so as to muffle the sounds emitted thereby. In this same regard, it is also preferable that the sounds generated by the sound emitting device appear to come from the sculpture (i.e. an animal) rather than from the speaker so as to hold the attention of young children.

Examples of portable sound emitting devices having an ornamental sculpture or figure affixed thereto are available by referring to one or more of the following United States patents:

| | |
|---|---|
| Des71,823 | January 11, 1927 |
| Des260,392 | August 25, 1981 |
| 3,315,966 | April 25, 1967 |
| 3,384,378 | May 21, 1968 |
| 3,921,331 | November 25, 1975 |
| 4,498,160 | February 5, 1985 |
| 4,521,205 | June 4, 1985 |

SUMMARY OF THE INVENTION

In general terms, means are disclosed by which to easily and reliably affix an ornamental sculpture to the front of an electronic sound emitting device, such as a portable audio cassette player, or the like. The ornamental sculpture includes a hollow interior, a contoured front end having an aesthetically pleasing shape, such as that resembling the face of an animal, or the like, and a flat rear end having an opening formed therethrough. The ornamental sculpture also includes a plurality of sound holes so that sounds generated by the sound emitting device and emitted by an audio speaker will appear to small children to emanate from the sculpture and the shape depicted thereby.

According to a first embodiment of the invention, the audio speaker is carried by a base located at one end of a speaker grille. The base is received within and mated to the ornamental sculpture at a peripheral channel surrounding the opening in the rear end thereof, whereby the speaker grille is attached to the sculpture and the audio speaker is surrounded by the sculpture in alignment with the sound holes thereof. Depending from the base of the speaker grille are a plurality of attachment legs which are snap fit into respective slots formed in the front of the sound emitting device, whereby to affix the speaker grille and the ornamental sculpture to which the grille is attached to the sound emitting device so that the audio speaker is located outside and suspended from the sound emitting device.

According to a second embodiment of the invention, a plurality of L-shaped attachment hooks project from the front of the sound emitting device. The attachment hooks are shaped to be received by respective slots formed in the rear end of the ornamental sculpture so as to drop into a peripheral channel surrounding the opening in the rear end of the sculpture. The ornamental sculpture is then rotated so that the attachment hooks ride through the peripheral channel and away from the slots, whereby to affix the sculpture to the sound emitting device. The audio speaker is mounted inside the front of the sound emitting device so as to be covered by the ornamental sculpture. A keyway is formed through the front of the device so that an audio transmission path is established between the speaker and the sound holes of the sculpture.

DETAILED DESCRIPTION

Figure 1:
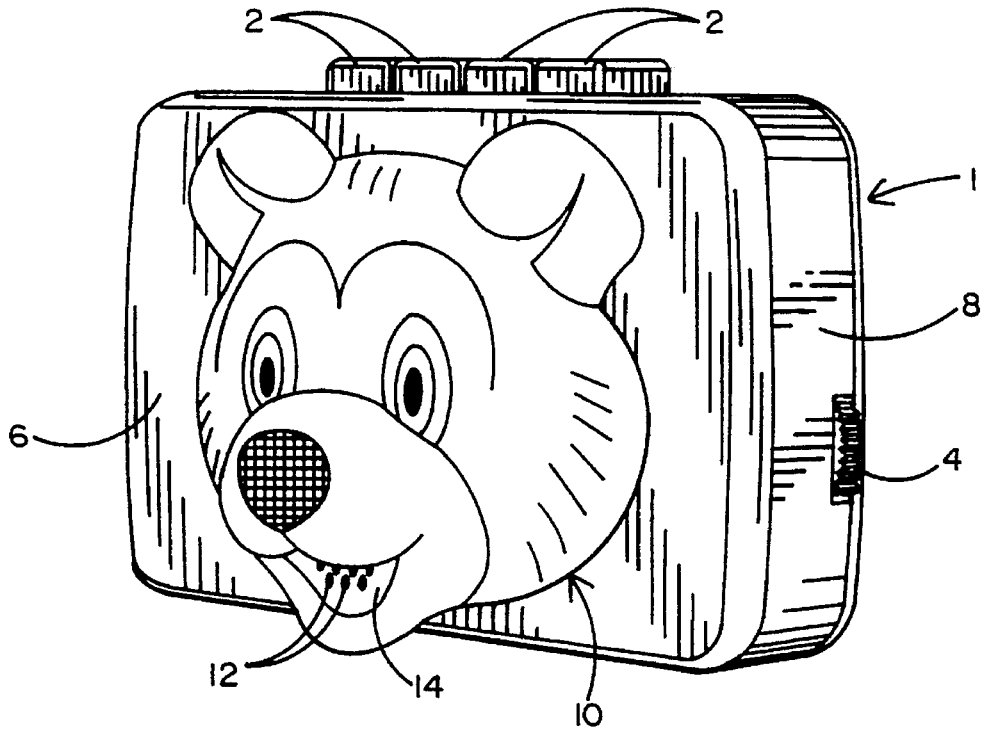
FIGS. 1 and 2 illustrate one example of an electronic sound emitting device to which an aesthetically pleasing ornamental sculpture has been affixed.
Figure 2:
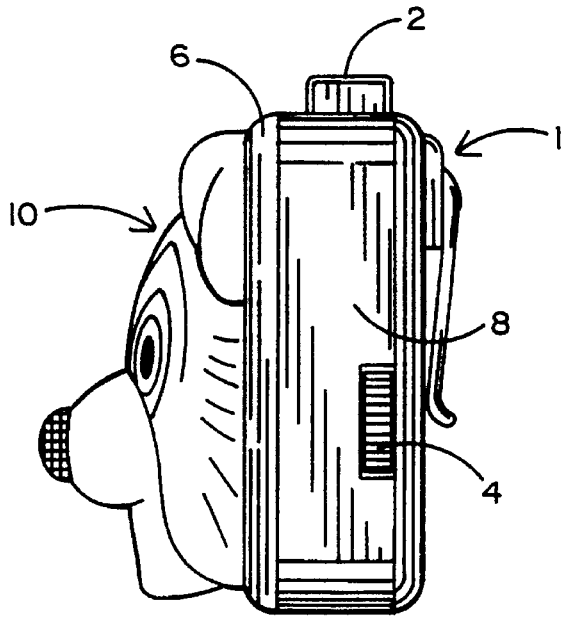

The means for affixing an ornamental sculpture to an electronic sound emitting device which form the present invention are now disclosed in detail while referring to the drawings. FIGS. 1 and 2 show an electronic sound emitting device to which an ornamental sculpture has been affixed accordingly to either one of the two embodiments to be described below. The electronic device to which the sculpture has been affixed is a portable audio cassette player 1 having the usual array of control buttons 2, a rotatable volume control 4, and a pivotal front door 6 that is hingedly connected to the body 8 of the cassette player 1. Although the electronic device illustrated is a portable cassette player 1, it is to be expressly understood that this is for purposes of illustration only, and other electronic sound emitting devices including, but not limited to, a walkie-talkie, a portable radio, and the like, may be substituted therefor.

The ornamental sculpture 10 which is shown affixed to the cassette player 1 of FIGS. 1 and 2 is shaped to depict the face of an animal (e.g. a bear). Although the sculpture 10 illustrated herein resembles the face of an animal, it is to be understood that this is for purposes of example only, and other aesthetically pleasing shapes, not limited to an animal face, may be substituted therefor. However, it is preferable that the ornamental sculpture 10 be formed (e.g. molded) from a relatively soft, resilient material having a spring-like memory.

The ornamental sculpture 10 of FIGS. 1 and 2 is affixed to the front door 6 of the cassette player 1. Since the cassette player 1 will emit sound (i.e. when an audio cassette is positioned inside the front door 6 and the appropriate control button 2 is depressed), it is preferable that the ornamental sculpture 10 have a plurality of sound holes 12 (best shown in FIG. 1) formed therethrough so that sound generated by cassette player 1 will not be muffled. Accordingly, it is desirable to locate the sound holes 12 in the mouth area 14 of the animal face represented by the ornamental sculpture 10 and to affix this sculpture to the front door 6 of the cassette player 1 so that the mouth area 14 is aligned with a speaker (designed 30 and described in greater detail hereinafter) that is covered by the sculpture 10 and suspended from the front door 6 outside the cassette player.

Referring now to FIGS. 3–9 of the drawings, means according to a first embodiment of this invention are described for affixing the ornamental sculpture 10 of FIGS. 1 and 2 to the cassette player 1. A (e.g. molded plastic) speaker grille 16 (best shown in FIGS. 7–9) includes an annular base 18 and a series of parallel aligned, laterally extending ribs 20 extending thereacross. A plurality of (e.g. four) gaps 22 are evenly spaced around the periphery of the base 18 of speaker grille 16, and a thin arcuate leg support member 24 fills each of the gaps 22. Depending from each leg support member 24 is a flexible attachment leg 26. An annular lip 28 projects outwardly from the underside of the base 18 to provide additional support for the attachment legs 26.

The diameter of annular lip 28 is sized slightly larger than the diameter of an audio speaker so that, in the assembled configuration, the speaker (designated 30 in FIGS. 3–6) is located inside the lip 28 to be supported by the ribs 20 of speaker grille 16. Also in the assembled configuration, the flexible attachment legs 26 depending from leg supports 24 are received (e.g. snap-fit) within respective slots 46 formed in the front door 6 of the cassette player 1 (best shown in FIG. 3) to enable the speaker grille 16 to be affixed to the front door. To facilitate the affixation of the speaker grille 16 to the cassette player 1, each attachment leg 26 of the speaker grille 16 has an inwardly turned finger 27 (best shown in FIG. 9) to prevent the inadvertent detachment of the legs 26 from receipt by the slots 46 in the front door 6.

Figure 3:
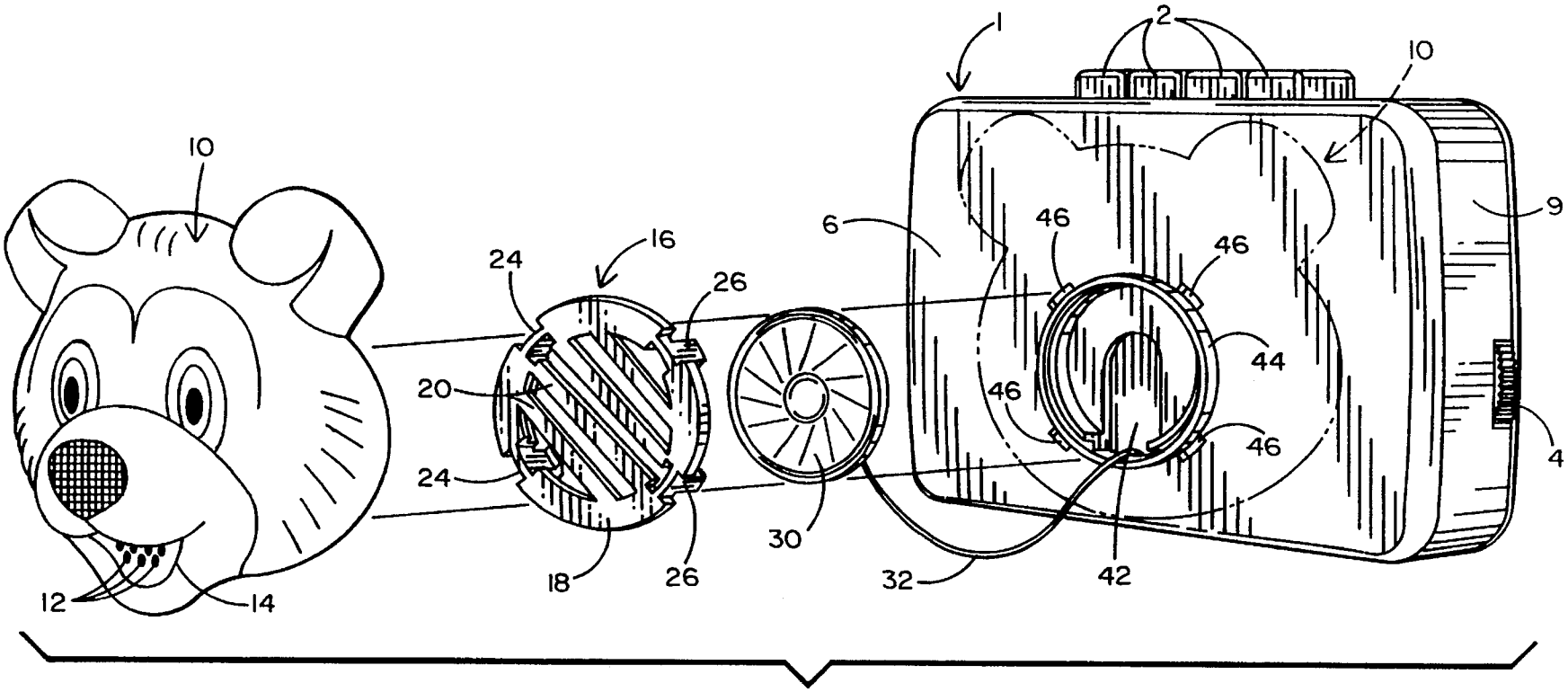
FIGS. 3 and 4 are exploded views showing the ornamental sculpture to be affixed to the sound emitting device of FIGS. 1 and 2 according to a first embodiment of the invention.
Figure 4:
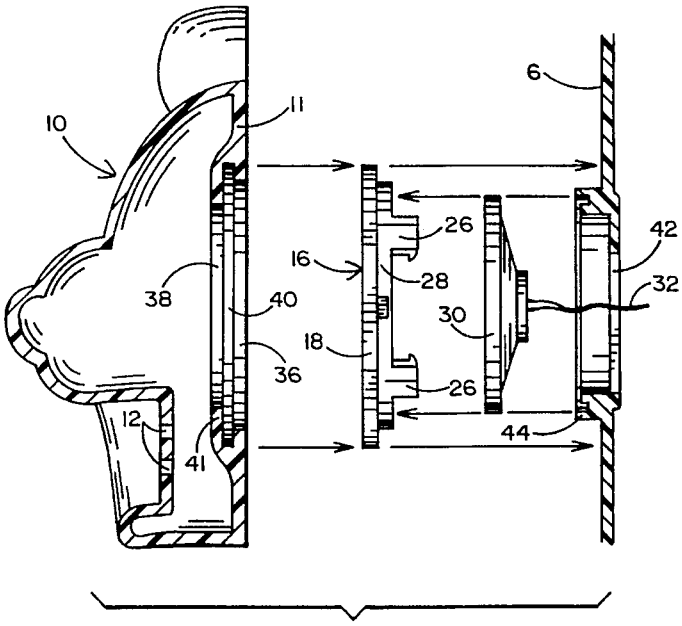
Figure 5:
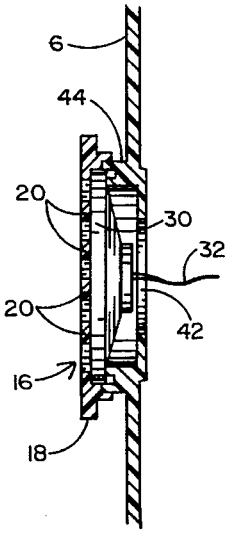
FIGS. 5 and 6 show a speaker grille attached to the front of the sound emitting device and supporting an audio speaker that emits the sounds generated by the sound emitting device.
Figure 6:
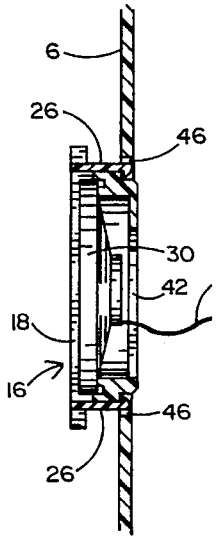
Figure 9:
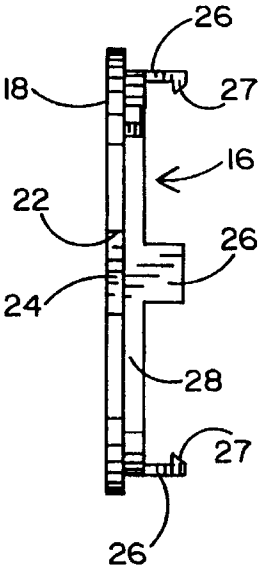
FIG. 9 is a side elevational view of the speaker grille.
Figure 8:
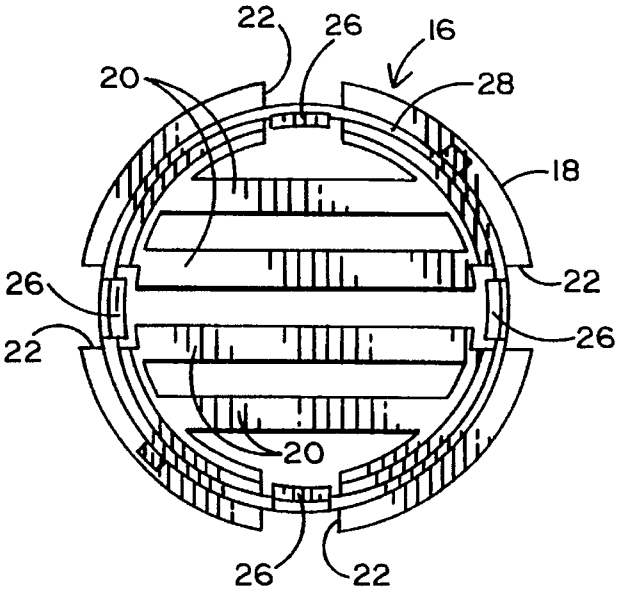
FIG. 8 is a bottom plan view of the speaker grille.
Figure 7:
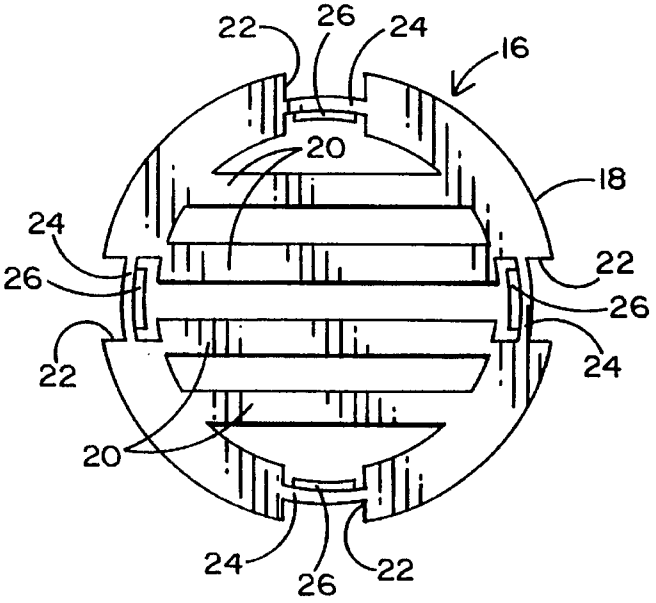
FIG. 7 is a top plan view of the speaker grille shown in FIGS. 5 and 6.

In FIGS. 4–6 of the drawings, the conical end of a conventional audio speaker 30 is shown located flush against the ribs 20 of speaker grille 16 below the annular base 18 thereof so that the conical end is received inside the annular lip 28. The speaker 30 may be adhesively bonded to the ribs 20 at the underside of the grille 16. A pair of electrical speaker wires 32 extends from the speaker 30 to be connected to the usual electronics of the cassette player 1 that are carried within the body 8 (best shown in FIG. 3).

As is best shown in FIG. 4, the resilient ornamental sculpture 10 includes a hollow interior, a contoured front end (resembling the face of an animal), and a flat rear end 11. To enable the ornamental sculpture 10 to be mounted at the front door 6 of the cassette player 1, the rear end 11 of the sculpture has an opening formed therethrough. The opening through the rear end 11 of sculpture 10 is defined by round outer and inner walls 36 and 38 that are spaced from one another and a peripheral channel 40 formed in the space between the walls. The diameter of the peripheral channel 40 is slightly longer than the diameter of the outer wall 36, which diameter is slightly longer than the diameter of the inner wall 38. The difference in the lengths of the diameters of the outer and inner walls 36 and 38 establishes an annular ledge 41 which extends around the inner wall 38.

Referring concurrently to FIGS. 3–6, a passageway 42 is shown formed through the front door 6 of the cassette player 1 to permit the speaker wires 32 to be connected from the speaker 30 outside the front door 6 to the electronics of the cassette player 1 located inside the front door 6 (best shown in FIG. 3). Surrounding the passageway 42 and extending outwardly from the front door 6 is an annular flange 44. A plurality of (e.g. four) slots 46 are also formed through the front door 6. The slots 46 are evenly spaced around the periphery of flange 44 and sized to receive respective attachment legs 26 which depend from the speaker grille 16.

That is to say, and in the assembled configuration with the legs 26 of speaker grille 16 snapped into the slots 46 of the front door 6, the conical end of the speaker 26 will be supported against the underside of the ribs 20 of speaker grille 16 and the opposite end of the speaker 26 will be disposed within the annular flange 46 to enable the speaker wires 32 to be easily fed to the interior of the cassette player 1 via the passageway 42 through front door 6. Next, the flexible sculpture 10 is manipulated such that the circumference of the annular base 18 of speaker grille 16 is received within the peripheral channel 40 (of FIG. 4) in the space between the inner and outer walls 36 and 38 that surround the opening formed in the rear end 11 of sculpture 10 with base 18 resting upon the ledge 41.

Accordingly, the receipt of the annular base 18 within the peripheral channel 40 serves to reliably affix the ornamental sculpture 10 to the speaker grille 16. Furthermore, the receipt of the attachment legs 26 within respective slots 46 in the front door 6 serves to reliably affix the speaker grille 16 (to which the sculpture 10 is affixed) to the cassette player 1. By virtue of the foregoing, the speaker 30 carried by grille 16 is suspended from the front door 6 outside the cassette player 1, whereby the speaker cone faces into the interior of the hollow sculpture 10 in alignment with the holes 12 through sculpture 10 so that the sound emitted by the speaker will not be muffled by the sculpture enclosure. Moreover, it will appear to small children as if the sound being emitted by the speaker 30 of cassette player 1 is otherwise generated from the mouth 14 of the ornamental sculpture 10. Thus, the animal depicted by the sculpture 10 will appear lifelike to certain users.

Referring to FIGS. 10–16 of the drawings, means according to a second embodiment of this invention are now described for affixing the resilient ornamental sculpture 10 shown in FIGS. 1 and 2 to the cassette player 1 or to a similar electronic sound emitting device. Like that previously described when referring to FIGS. 3–9, the ornamental sculpture 10 illustrated in FIGS. 1 and 2 is affixed to the front door 6 of the cassette player 1. To this end, a keyway 50 is formed through the front door 6 of cassette player 1. A plurality of (e.g. four) L-shaped attachment hooks 52 are spaced evenly from one another around the periphery of keyway 50 (best shown in FIG. 10).

Figure 12:
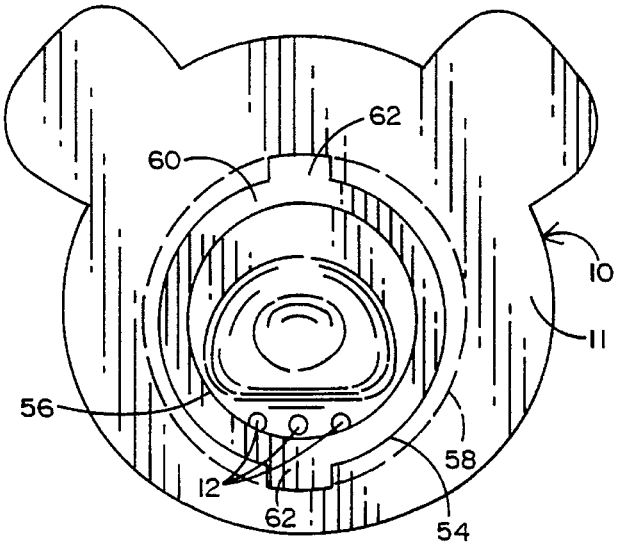
FIG. 12 shows the rear end of the ornamental sculpture detached from the sound emitting device.
Figure 13:
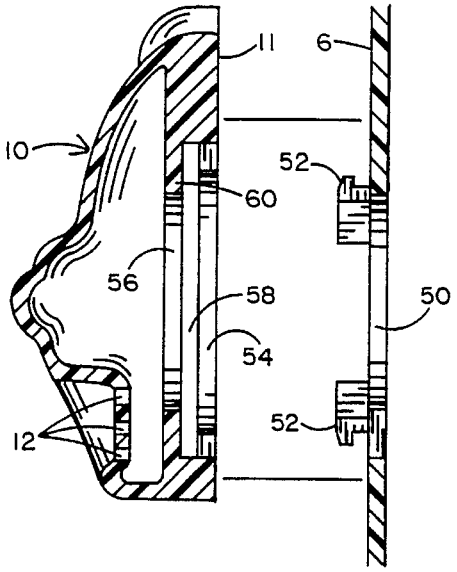
Figure 14:
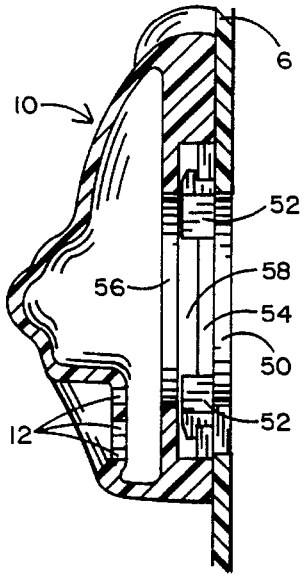
FIG. 14 shows the ornamental sculpture affixed to the front of the sound emitting device.
Figure 15:
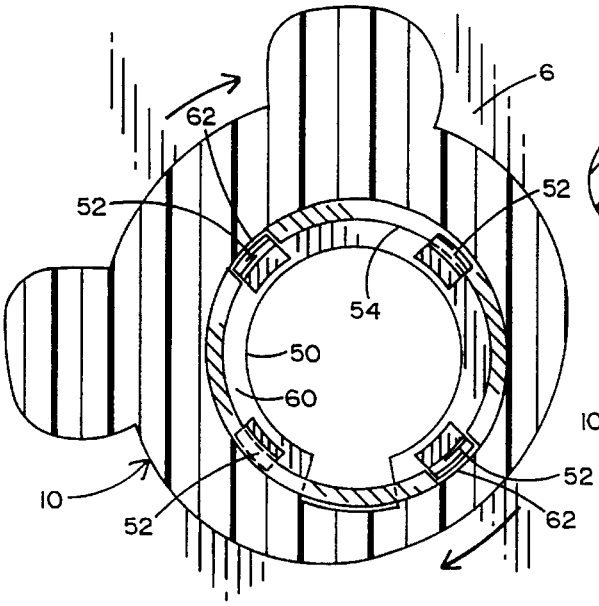
FIGS. 15 and 16 show the steps by which to affix the ornamental sculpture to the sound emitting device according to the second embodiment.

As is best shown in FIGS. 12–14, the ornamental sculpture 10 includes a hollow interior, a contoured front end (e.g. resembling the face of an animal), and a flat rear end 11. To enable the sculpture 10 to be mounted at the front door 6 of the cassette player 1 according to the second embodiment of the invention, the rear end 11 is provided with an opening formed therethrough. The opening through the rear end 11 of sculpture 10 is defined by round outer and inner walls 54 and 56 that are spaced from one another and a peripheral channel 58 formed in the space between walls 54 and 56. The diameter of the peripheral channel 58 is slightly longer than the diameter of the outer wall 54, which diameter is slightly longer than the diameter of the inner wall 56. The difference in the lengths of the diameters of the outer and inner walls 54 and 56 establishes an annular ledge 60 which extends around the inner wall 56.

A plurality of (e.g. two) radially extending slots 62 are formed through the rear end 11 of sculpture 10 so as to project outwardly from the outer wall 54. The radial slots 54 are located above and drop downwardly into the peripheral channel 58 between outer and inner walls 54 and 56.

Referring concurrently to FIGS. 13–16, the ornamental sculpture 10 having the radially projecting slots 62 formed in the rear end 11 thereof is moved towards the front door 6 of the cassette player 1 having the attachment hooks 52 projecting outwardly therefrom (best shown in FIG. 13). The sculpture 10 is attached to the front door 6 by mating a pair of the attachment hooks 52 to a corresponding pair of the slots 62 in outer wall 54. The hooks 52 received in slots 62 will drop through the slots 62 and fall into the peripheral channel 58 in the space between the outer and inner walls 54 and 56. The resilient ornamental sculpture 10 is then manipulated (i.e. stretched) so that the remaining attachment hooks 52 are also received within the peripheral channel 58. To assure proper affixation of the ornamental sculpture 10 to the front door 6 of cassette player 1, the sculpture 10 is rotated with respect to the front door, such that each of the attachment hooks 52 rides through the peripheral channel 58, around the ledge 60 and away from slots 62 (best shown in FIG. 15).

Figure 16:
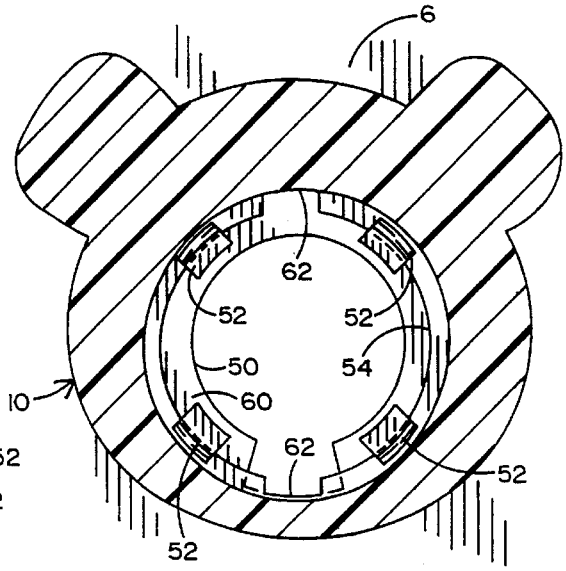

When the ornamental sculpture 10 is rotated to its desired orientation relative to the cassette player 1 (as illustrated in FIGS. 1 and 2), a portion of each attachment hook 52 projecting from the front door 6 will be disposed within the peripheral channel 58 and covered by the outer wall 54 (best shown in FIGS. 14 and 16). Thus, the engagement of the attachment hooks 52 by and below outer wall 54 will prevent the sculpture 10 from being inadvertently pulled off the front door 6.

Figure 10:
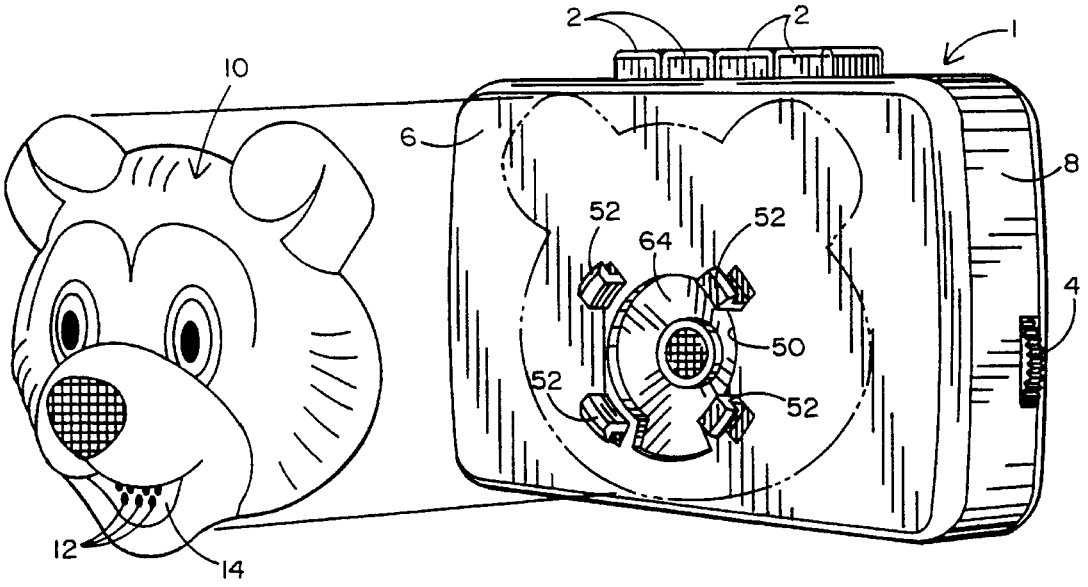
FIGS. 10 and 13 are exploded views showing the ornamental sculpture to be affixed to the sound emitting device of FIGS. 1 and 2 according to a second embodiment of the invention.
Figure 11:
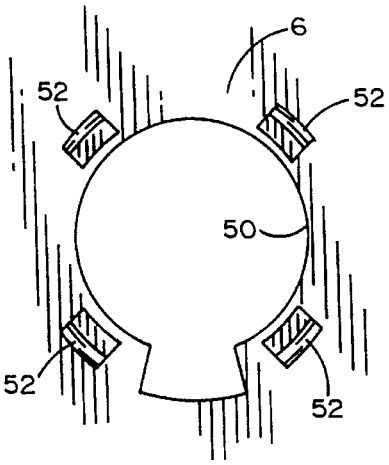
FIG. 11 illustrates an enlarged detail of the front of the sound emitting device showing a plurality of attachment hooks projecting therefrom to be mated to slots formed in the ornamental sculpture.

As is best illustrated in FIG. 10, the speaker 64 of cassette player 1 and the speaker wires (not shown) are located entirely inside the front cover 6. In this second embodiment of the invention, the speaker 64 is covered by the ornamental sculpture 10 and aligned with the keyway 50 through the front door 6 so as to create an audio transmission path between the speaker 64 and the holes 12 through the mouth 14 of the animal depicted by the ornamental sculpture 10. To this end, the keyway 64 extends radially downward so that communication between the speaker 64 and the holes 12 through sculpture 10 will not be blocked when the sculpture is affixed to the cassette player 1 in the assembled configuration of FIGS. 14 and 16. In this regard, and like the cassette player 1 illustrated in FIGS. 3–8, it will appear to small children as if the sound emitted by the speaker 64 of the cassette player 1 illustrated in FIGS. 9–14 is generated from the mouth 14 of the ornamental sculpture 10 to enhance the life-like appearance of the animal depicted by the sculpture.

By virtue of the first and second embodiments described herein, an ornamental sculpture may be quickly and easily affixed to an electronic sound emitting device without using bonding or adhesive agents at the interface therebetween. Nevertheless, a suitable adhesive may be used in the event that the sculpture is to be permanently affixed to the sound emitting device.

It will be apparent that while preferred embodiments of the invention have been shown and described, various modifications and changes may be made without departing from the true spirit and scope of this invention.

Having thus set forth the preferred embodiments, what is claimed is:

1. A combination comprising a sound emitting device, an ornamental sculpture, and means to affix said ornamental sculpture to said sound emitting device, said ornamental sculpture having an opening formed therein, and said sound emitting device having a plurality of slots formed therein, and said means to affix said ornamental sculpture to said sound emitting device including coupling means having a first end received through and retained within the opening of said ornamental sculpture, whereby the first end of said coupling means is attached to said sculpture, said coupling means also having a plurality of flexible legs projecting therefrom and snap-fit within respective ones of said slots in said sound emitting device, whereby said coupling means and the ornamental sculpture attached thereto are affixed to said sound emitting device.

2. The combination recited in claim 1, further comprising an audio speaker to emit sounds produced by said sound emitting device, said speaker attached to the first end of said coupling means and supported by said first end at a location outside of said sound emitting device to be surrounded by said ornamental sculpture.

3. The combination recited in claim 2, further comprising electrically conductive wires connected between said audio speaker located outside said sound emitting device and the interior of said sound emitting device, said sound emitting device having a hole therein to permit said wires to pass therethrough.

4. The combination recited in claim 2, wherein said audio speaker attached to the first end of said coupling means is received within the opening in said ornamental sculpture.

5. The combination recited in claim 4, wherein said ornamental sculpture has a hollow interior and a plurality of sound holes formed through said sculpture opposite said opening therein, said audio speaker received within said opening and aligned with said sound holes so that sounds emitted by said speaker pass through said sound holes.

6. The combination recited in claim 1, wherein said ornamental sculpture includes a first wall surrounding the opening formed in said sculpture, the first end of said coupling means moved through said opening for receipt by said sculpture inwardly of said first wall whereby to attach said coupling means to said sculpture.

7. The combination recited in claim 6, wherein said ornamental sculpture includes a second wall surrounding the opening formed in said sculpture and spaced from said first wall such that a channel is formed between said first and second walls, the first end of said coupling means moved through said opening for engagement by said sculpture at said channel between said first and second walls.

8. The combination recited in claim 6, wherein said ornamental sculpture is manufactured from a resilient material having a spring-like memory.

9. A combination comprising a sound emitting device, an ornamental sculpture, and means to affix said ornamental sculpture to said sound emitting device, said ornamental sculpture having a hollow interior and an opening communicating with the hollow interior, and said sound emitting device having a plurality of slots formed therein, said means to affix said ornamental sculpture to said sound emitting device including coupling means having a base and a plurality of legs projecting therefrom and adapted to be received within respective ones of said plurality of slots in said sound emitting device, whereby said coupling means is affixed to said sound emitting device, said ornamental sculpture also having first and second walls, said first wall surrounding the opening in said ornamental sculpture and said second wall located at the hollow interior of said ornamental sculpture and spaced inwardly of said first wall such that a channel is formed between said first and second walls, said base of said coupling means moving through said opening and into the interior of said ornamental sculpture for receipt at said channel between said first and second walls for connecting said coupling means and said sound emitting device affixed thereto to said ornamental sculpture.

10. The combination recited in claim 9, wherein said plurality of legs projecting from said coupling means are flexible so as to be snap-fit within respective ones of said plurality of slots in said sound emitting device.

11. The combination recited in claim 9, wherein said sound emitting device is a portable cassette player.

* * * * *